US007461944B2

(12) United States Patent
Alessio

(10) Patent No.: US 7,461,944 B2
(45) Date of Patent: Dec. 9, 2008

(54) LED LIGHTING DEVICE

(75) Inventor: David J. Alessio, Amherst, OH (US)

(73) Assignee: Eveready Battery Company, Inc., St. Louis, MO (US)

( * ) Notice: Subject to any disclaimer, the term of this patent is extended or adjusted under 35 U.S.C. 154(b) by 58 days.

(21) Appl. No.: 10/518,219

(22) PCT Filed: Jun. 20, 2003

(86) PCT No.: PCT/US03/19385

§ 371 (c)(1),
(2), (4) Date: Dec. 16, 2004

(87) PCT Pub. No.: WO2004/003428

PCT Pub. Date: Jan. 8, 2004

(65) Prior Publication Data

US 2006/0087842 A1 Apr. 27, 2006

Related U.S. Application Data

(60) Provisional application No. 60/390,245, filed on Jun. 20, 2002.

(51) Int. Cl.
*F21L 4/02* (2006.01)

(52) U.S. Cl. ..... 362/184; 362/244; 362/322; 362/800

(58) Field of Classification Search ..... 362/284, 362/235, 800, 237, 240, 244, 245, 208, 251, 362/394, 184, 185, 326, 322
See application file for complete search history.

(56) References Cited

U.S. PATENT DOCUMENTS 1,986,281 A * 1/1935 Nygard ..... 362/197
2,101,479 A * 12/1937 Schenk ..... 362/184

(Continued)

FOREIGN PATENT DOCUMENTS

CN 2556474 Y 6/2003

(Continued)

OTHER PUBLICATIONS

European Patent Office (EPO), Communication pursuant to Article 94(3) EPC for Application No. 03761950.9 filed Nov. 25, 2004, mailed Feb. 28, 2008, 5 pages, European Patent Office, Germany.

(Continued)

*Primary Examiner*—Sandra L. O'Shea
*Assistant Examiner*—Gunyoung T. Lee
(74) *Attorney, Agent, or Firm*—Gregory J. Adams

(57) ABSTRACT

A lighting device (10) is provided which uses multiple LEDs to illuminate a target area. The lighting device includes first and second light emitting diodes (24, 26) spaced apart from each other. A first convex magnifier lens (34) is arranged in a light path of the first light emitting diode (24) for focusing light onto a target area. A second convex magnifier lens (36) is arranged in a light path of the second light emitting diode (26) for focusing light onto the same target area. The first and second magnifier lenses (34, 36) are supported relative to the first and second light emitting diodes (24, 26), respectively, by a cover (32).

19 Claims, 3 Drawing Sheets

U.S. PATENT DOCUMENTS

| | | | | | |
|---|---|---|---|---|---|
| 2,138,723 | A | * | 11/1938 | Bell | 396/182 |
| 2,566,280 | A | * | 8/1951 | Yandt | 362/184 |
| 3,517,185 | A | * | 6/1970 | Bacevius et al. | 362/183 |
| 4,740,066 | A | * | 4/1988 | Whitehead | 359/841 |
| 4,740,872 | A | * | 4/1988 | Chou | 362/183 |
| 4,797,793 | A | * | 1/1989 | Fields | 362/105 |
| 4,935,665 | A | * | 6/1990 | Murata | 313/500 |
| 5,101,326 | A | * | 3/1992 | Roney | 362/545 |
| 5,174,649 | A | * | 12/1992 | Alston | 362/244 |
| 5,224,772 | A | * | 7/1993 | Fustos | 362/105 |
| 5,237,490 | A | * | 8/1993 | Ferng | 362/183 |
| 5,408,393 | A | * | 4/1995 | Becker | 362/105 |
| 5,515,253 | A | * | 5/1996 | Sjobom | 362/244 |
| 5,580,156 | A | * | 12/1996 | Suzuki et al. | 362/184 |
| 5,595,435 | A | * | 1/1997 | Palmer et al. | 362/109 |
| 5,896,093 | A | * | 4/1999 | Sjobom | 340/815.75 |
| 6,012,824 | A | * | 1/2000 | Sharrah et al. | 362/199 |
| 6,095,661 | A | * | 8/2000 | Lebens et al. | 362/184 |
| 6,152,590 | A | * | 11/2000 | Furst et al. | 362/545 |
| 6,168,288 | B1 | * | 1/2001 | St. Claire | 362/184 |
| 6,290,368 | B1 | * | 9/2001 | Lehrer | 362/187 |
| 6,402,347 | B1 | * | 6/2002 | Maas et al. | 362/294 |
| 6,414,801 | B1 | * | 7/2002 | Roller | 359/726 |
| 6,485,160 | B1 | * | 11/2002 | Sommers et al. | 362/184 |
| 6,746,124 | B2 | * | 6/2004 | Fischer et al. | 353/43 |
| 6,857,756 | B2 | * | 2/2005 | Reiff et al. | 362/184 |
| 6,979,104 | B2 | * | 12/2005 | Brass et al. | 362/231 |

FOREIGN PATENT DOCUMENTS

| | | | |
|---|---|---|---|
| CN | 1450300 | A | 10/2003 |
| DE | 3323432 | A | 1/1984 |
| DE | 20112889 | U1 | 11/2001 |
| GB | 2329011 | A | 10/1999 |
| JP | 11224501 | A | 10/1998 |
| WO | 9911498 | A1 | 3/1999 |

OTHER PUBLICATIONS

Patent Office of the People's Republic of China Office Action for Application No. 03814320.8, filed Jun. 20, 2003, mailed Jan. 4, 2008, 15 pages, Chinese Patent Office.

* cited by examiner

LED LIGHTING DEVICE

CROSS-REFERENCE TO RELATED APPLICATION

This application claims the benefit of U.S. Provisional Application No. 60/390,245, filed Jun. 20, 2002, the entire disclosure of which is hereby incorporated herein by reference.

BACKGROUND OF THE INVENTION

The present invention generally relates to portable lighting devices (e.g., flashlights) and, more particularly, to a lighting device using multiple light emitting diodes (LEDs) as the light source.

Many light illuminating devices, such as flashlights, typically employ an incandescent lamp as the light source. Light emitting diodes (LEDs) offer many advantages over conventional incandescent lamps. LEDs are durable, have a lamp life of about 8,000 hours; and because they operate at low current drains, the useful life of energy storage batteries powering LEDs is extended. Despite these advantages, there are certain aspects of LEDs which limit their usefulness in certain applications, such as in portable lighting devices. The best standard 5 mm white LEDs currently available on the market are typically rated at about 3.6 volts, 30 milliamps (mA), and produce less than four (4) lumens of light. In comparison, an incandescent lamp used in conventional lighting devices with a similar voltage rating will typically produce light output that can range from less than ten (10) lumens to greater than forty (40) lumens or anywhere in between.

A solution to overcome the limitation of the LED currently being investigated is to use multiple LEDs as the light source in the lighting device. Some portable lighting devices currently use up to ten (10), or even more, LEDs as the light source, which increases the cost of the lighting device. Additionally, the light rays emitted by each LED are dispersed (e.g., forty degrees), and simply using multiple LEDs as the light source does not cure this problem.

One further approach to the solution is disclosed in U.S. Pat. No. 5,174,649 which employs one or more LEDs that illuminate portions of a single refractive lens element having hyperboloidal surfaces which translate the LEDs emitted rays into substantially parallel beams within the single refractive lens element. Another approach employing multiple LEDs in a flashlight is disclosed in U.S. Pat. No. 6,485,160 which employs multiple reflector wells, each housing an LED and a lens. While such approaches provide some directivity and concentration of light rays emitted from multiple LEDs, drawbacks still exist. For example, the formation of a complex refractive lens element and the requirement of the multiple reflector wells add to the cost and complexity of the lighting device.

In view of these disadvantages, it would be desirable to have an LED-based lighting system for a portable lighting device, which emitted light in a directed and concentrated manner.

SUMMARY OF THE INVENTION

In accordance with the teachings of the present invention, a lighting device is provided which uses multiple LEDs to illuminate a target area. The lighting device includes a housing and first and second light emitting diodes located on the housing and spaced from each other. The lighting device also includes a first magnifier lens arranged in a light path of the first light emitting diode for focusing a first light beam onto a target area, and a second magnifier lens arranged in a light path of the second light emitting diode for focusing a second light beam onto the target area The lighting device further has a support member for supporting the first and second magnifier lenses relative to the first and second light emitting diodes, respectively.

In another aspect of the present invention, the support member is a cover extending over the front of the housing, and the cover has a non-reflective inner wall. In a further aspect of the present invention, the lighting device comprises first and second convex magnifier lenses. The axes of the first and second LEDs are parallel to each other, and each magnifier lens is positioned orthogonal to the axis of the first and second LEDs, respectively.

The lighting device of this invention takes advantage of the positive attributes of LEDs, while minimizing costs. The lighting device is designed to produce a spotlight beam from each individual LED and magnifier lens combination which overlaps with the spotlight beam produced by each adjacent LED and magnifier lens combination. The target area is illuminated with a substantially single spotlight beam which shows excellent symmetry and high, uniform intensity.

These and other features, advantages and objects of the present invention will be further understood and appreciated by those skilled in the art by reference to the following specification, claims and appended drawings.

BRIEF DESCRIPTION OF THE DRAWINGS

The present invention will now be described, by way of example, with reference to the accompanying drawings, in which.

DETAILED DESCRIPTION OF THE PREFERRED EMBODIMENT

Figure 1:
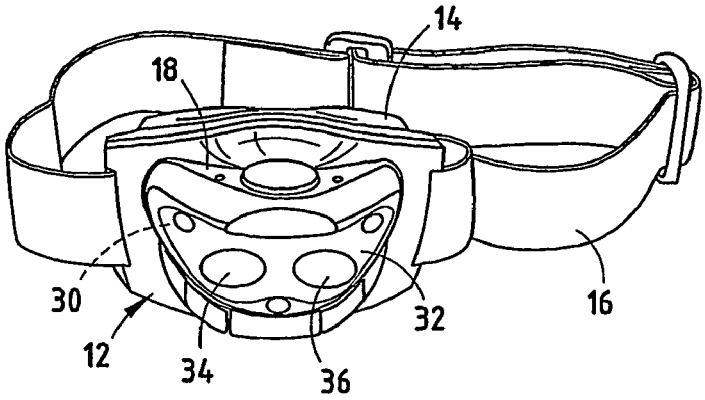
FIG. 1 is a perspective view of a headlamp lighting device utilizing the multiple LED lighting system of the present invention.

Referring to FIG. 1, a lighting device 10 is shown employing multiple light emitting diodes (LEDs) and multiple magnifier lenses according to one embodiment of the present invention. The lighting device 10 is shown as a headlamp flashlight (e.g., spotlight) having an adjustable strap 16 adaptive to be worn on the head of a user. While the lighting device 10 is shown and described herein as a headlamp flashlight, it should be appreciated that the lighting device 10 may be employed in any of a number of lighting systems to provide light illumination to a target area.

Figure 3:
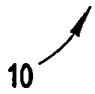
FIG. 3 is a cross-sectional view of the front portion of the lighting device.
Figure 3:
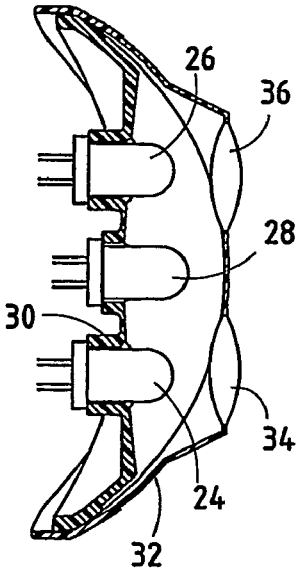
Figure 2:
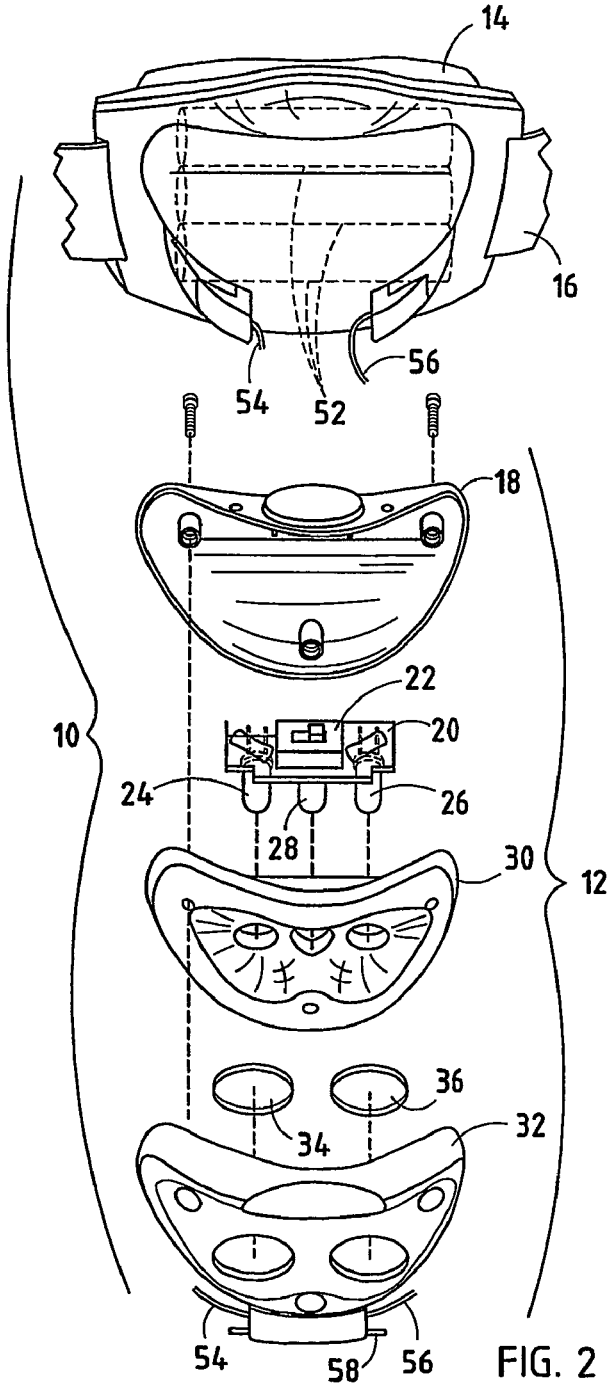
FIG. 2 is an exploded view of the lighting device of FIG. 1.

As shown in FIGS. 1-3, the lighting device 10 generally includes a rear housing 14 connected to an adjustable strap (headband) 16. The rear housing 14 provides a compartment for housing a plurality of energy storage batteries 52 (e.g., AA-type alkaline batteries) which serve as the electrical power source. The lighting device 10 further includes a front housing assembly 12 containing the light source and light focusing components of the lighting device 10. The front housing assembly 12 has a molded housing 18 forming the rear and side walls. Located within the housing 18 is a printed circuit board 20 having a light control switch 22 and other electrical circuitry (not shown) for controlling energization of the lighting device 10 by controlling the application of electrical current from the power source to the light source. According to one embodiment, the control switch 22 is a manually-actuated, three-position switch having a first position in which all the LEDs are turned off, a second position to turn on two LEDs, and a third position to turn on a third LED.

The lighting device 10 includes, as the light source, a plurality of light emitting diodes (LEDs) that are shown connected to the printed circuit board 20 which, in turn, is connected to housing 18. The LEDs include a first LED 24 spaced from a second LED 26 for generating first and second light beams, respectively. Also shown disposed between first and second LEDs 24 and 26 is a third LED 28 for emitting a third light beam. The LEDs 24, 26, and 28 used as the light source in the lighting device 10 of the present invention are commercially available from a variety of sources. One example of a commercially available white LED is Model No. NSPW500BS available from Nichia Corporation. It should be appreciated that various kinds of LEDs are readily available from several commercial suppliers. The LEDs 24, 26, and 28 can be of any color, depending upon the choice of the users. According to one embodiment, the first and second LEDs 24 and 26 are white LEDs made by Nichia Corporation, and the third LED 28 is a red-colored LED.

The lighting device 10 also includes an inner cover 30 fastened to front housing 18 to provide a covering over the printed circuit board 20. Inner cover 30 has openings for allowing the first, second, and third LEDs 24-28 to extend therethrough forward of the inner cover 30. Assembled to the front of inner cover 30 is an outer cover and support member 32 that covers the front face of cover 30 forward of LEDs 24, 26, and 28. Outer cover and support member 32 supports the first and second magnifier lenses 34 and 36 and forms a cover on front housing 18. The inner wall of outer cover and support member 32 is non-reflective, and thus does not reflect any substantial light rays. The first and second magnifier lenses 34 and 36 may be integrally formed within the outer cover and support member 32 or may otherwise be attached to outer cover and support member 32. According to one embodiment, the outer cover and support member 32 is made of a polymeric material (e.g., plastic) and the magnifier lenses 34 and 36 are integrally formed within the polymeric material. In a further embodiment, cover member 32 is made of a substantially transparent material that allows light rays to pass through.

The magnifier lenses 34 and 36 are light transparent optics magnifiers that magnify light transmitted through the lens and direct the magnified light in a light beam. The magnifier lenses 34 and 36 may each be configured as a double convex magnifier lens as shown, according to one embodiment. According to another embodiment, the magnifier lenses 34 and 36 may each include a plano convex magnifier lens. The magnifier lenses 34 and 36 each have at least one convex surface to provide magnification to focus the light beam. The magnifier lenses 34 and 36 can be made of any transparent material, such as glass or polymer (e.g., polycarbonate). The dimensions of the magnifier lenses 34 and 35 can vary depending upon the spotlight diameter desired by the user. The magnifier lenses 34 and 36 used in the present invention are commercially available from a variety of sources and may each include a polycarbonate double convex magnifier lens having Model No. NT32-018, commercially available from Edmund Industrial Optics, having a diameter of nine millimeters (9 mm) and a focal length of nine millimeters (9 mm).

Electrical power lines 54 and 56 extend between the printed circuit board 20 within the front housing 18 and the energy storage batteries 52 located in rear housing 14. The electrical power lines 54 and 56 supply electrical current (e.g., direct current) from the batteries 52 to the LEDs 24-28 to power the LEDs 24, 26, and 28 which generate the corresponding light beams. According to one embodiment, the third LED 28 may be illuminated separate from LEDs 24 and 26 to provide a light beam of a different color as compared to LEDs 24 and 26. According to one embodiment, LEDs 24 and 26 provide a white light beam, while LED 28 provides a red colored light beam.

Formed at the bottom of front housing assembly 12, along the bottom edge of support member 32, is a hinge assembly 58 that is connected to the rear housing 14. Hinge assembly 58 is rotatable about a horizontal axis to allow the front housing assembly 12 and corresponding LED 24-28 and magnifier lenses 34 and 36 to rotate relative to the rear housing 14. This enables a user to rotate front housing assembly 12 to adjust the height positioning of the illuminating light beams.

Figure 4:
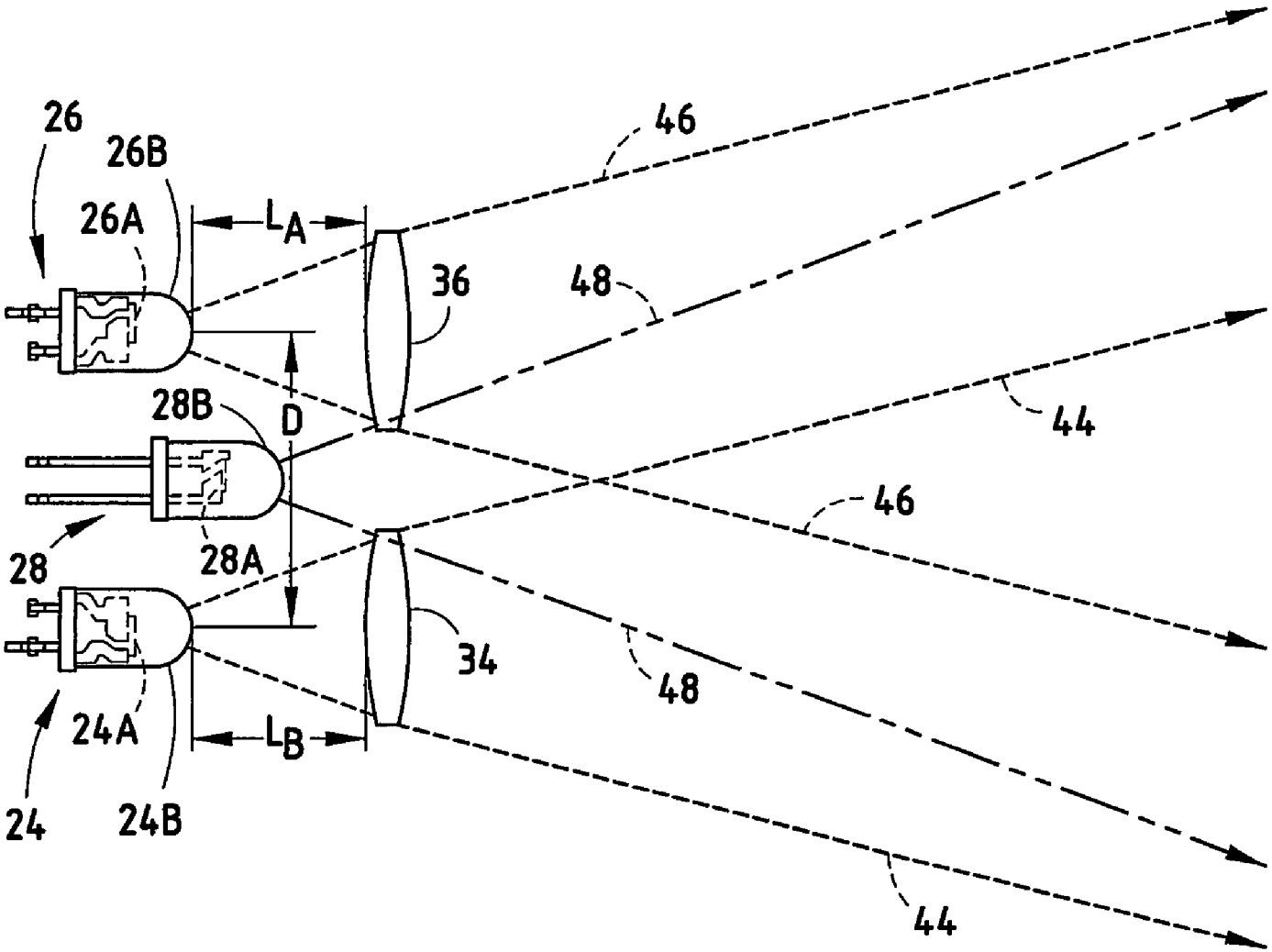
FIG. 4 is a top view layout of the multiple LEDs and magnifier lenses in the lighting device of the present invention.
Figure 5:
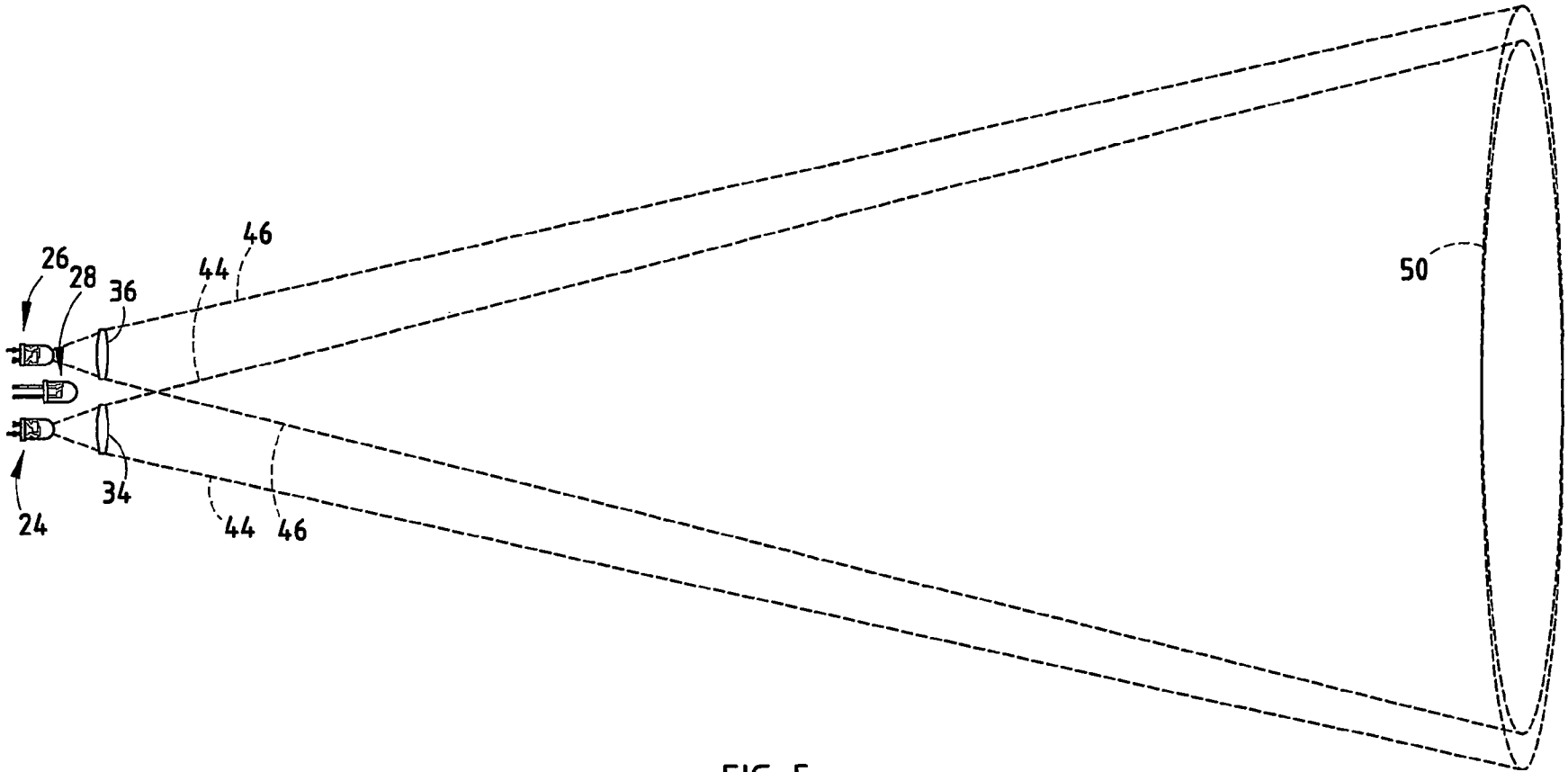
FIG. 5 is a reduced top view layout of the multiple LEDs and magnifier lenses, further illustrating the resultant spotlight beam coverage.

The lighting systems arrangement of the LEDs 24-28 and magnifier lenses 34 and 36 is best illustrated in FIGS. 3 through 5. First and second LEDs 24 and 26 are arranged relative to magnifier lenses 34 and 36 to produce first and second light beams 44 and 46, respectively. The first LED 24 illuminates the first magnifier lens 34 to generate a first light beam generally within a defined full angle field of view of about forty degrees (40°). Substantially all of the light generated by the first LED 24 is illuminated onto the first magnifier lens 34 which magnifies and redirects the first light beam in a path shown in FIGS. 4 and 5 by dashed lines 44. The second LED 26 likewise illuminates the second magnifier lens 34 to generate a second light beam within a defined full angle field of view of about forty degrees (40°). The light beam generated by the second LED 26 is illuminated onto the second magnifier lens 36 which refocuses and directs the light beam in a second path shown by dashed lines 46.

Light beams 44 and 46 are shown substantially overlapping and substantially cover a common target area 50 to form a single spotlight having excellent symmetry and uniform intensity. By employing the arrangement of the first and second LEDs 24 and 26 and magnifier lenses 34 and 36, respectively, focused onto a single target area 50, increased brightness illumination is achieved in target area 50.

The third LED 28 is shown generating a light beam in a path shown by phantom lines 48 that extends substantially between an opening between magnifier lenses 34 and 36. The light beam 48 generated by LED 28 is emitted within a full angle wide field of view of about forty degrees (40°). Accordingly, a substantial portion of the light beam 48 generated by a third LED 28 is not directed through a magnifier lens and, hence, is not magnified and focused onto the focal target area 50. Instead, the third LED 28 illuminates a wider angle of coverage and, thus, operates more as a floodlight.

Each of the three LEDs 24-28 includes an electrically powered diode shown as diodes 24A, 26A, and 28A, respectively. The diodes 24A, 26A, and 28A generate light rays in response to the application of electrical current. Each of the diodes 24A, 26A, and 28A are shown enclosed within a transparent housing 24B, 26B, and 28B, respectively. While lamp-type LEDs are shown and described herein, it should be appreciated that other LEDs maybe employed in the lighting device 10.

The first and second LEDs 24 and 26 are spaced apart from each other by distance D which is measured from the center of the LEDs. In one embodiment, distance D is about 18.2 mm.

The magnifier lenses 34 and 36 can be glass (SF5) double convex magnifier lenses which, in one embodiment, are 9 mm in diameter with a 9 mm effective focal length. Magnifier lens 34 is positioned orthogonal to first LED 24, while magnifier lens 36 is positioned orthogonal to second LED 26. The central focal axes of first and second LEDs 24 and 26 are parallel to each other. The surface of the magnifier lenses 34 and 36 can be placed from the tip of their respective LEDs at a distance $L_A$ and $L_B$ to allow for a back focal length of 7.9 mm, according to one embodiment. This is the distance $L_A$ and $L_B$ between the focal point within the first and second LEDs 24 and 26 and the surface of the corresponding lenses 34 and 36, respectively.

The spotlight beam produced from the first LED 24 and magnifier lens 34 combination substantially overlaps with the spotlight beam produced from the second LED 26 and magnifier 36 combination. The overlap may be less than a complete overlap of light beams 44 and 46 due to the offset arrangement of the perpendicular LED 24 and 26 and magnifier lenses 34 and 36 combinations. However, the combination of LEDs 24 and 26 and magnifier lenses 34 and 36 can result up to a two hundred percent (200%) increase in beam intensity, as compared to a single LED alone.

Accordingly, the lighting device 10 of the present invention advantageously produces an enhanced intensity and uniform spot beam focused onto a target area 50 by employing multiple LEDs at a minimal cost. While light beams 44 and 46 do not completely overlap when offset magnifier lenses 34 and 36 are arranged orthogonal to LEDs 24 and 26, the resultant light beams 44 and 46 do substantially overlap in target area 50. The overlapping target area 50 could further be refined by tilting magnifier lenses 34 and 36 towards a common target area so as to focus beams 44 and 46 onto an overlapping target area. However, the tilting of magnifier lenses 34 and 36 may change the shape of the resultant light beams 44 and 46.

The power source used in the light system of the present invention can be any conventional power source. AC and DC current can be used. Conventional dry cell batteries, for example, zinc/$MnO_2$, carbon/zinc, nickel metal hydride, or lithium-based electrochemical cells can all be used.

It will be understood by those who practice the invention and those skilled in the art, that various modifications and improvements may be made to the invention without departing from the spirit of the disclosed concept. The scope of protection afforded is to be determined by the claims and by the breadth of interpretation allowed by law.

The invention claimed is:

1. A lighting device comprising:

a housing;

a first light emitting diode located on the housing;

a second light emitting diode located on the housing and spaced from the first light emitting diode;

a first tilting magnifier lens arranged in a light path of the first light emitting diode for focusing a first light beam onto a target area;

a second tilting magnifier lens arranged in a light path of the second light emitting diode for focusing a second light beam onto the target area;

a rear housing coupled to a back side of the housing, the rear housing having a battery compartment;

a cover disposed over a front of the housing, the cover supporting the first and second tilting magnifier lenses relative to the first and second light emitting diodes; and a third light emitting diode located between the first and the second light emitting diodes, wherein a light path of the third light emitting diode projects through a region of the cover disposed between the first and second tilting magnifier lenses.

2. The lighting device as defined in claim 1, wherein the front housing is pivotally connected to the rear housing to allow the front housing and the light emitting diodes to be moved relative to the rear housing.

3. The lighting device as defined in claim 1, wherein the third light emitting diode provides a flood light.

4. The lighting device as defined in claim 1, wherein the third light beams has a field of view of about forty degrees.

5. The lighting device of claim 1, wherein the first and second light beams substantially overlap.

6. The lighting device of claim 1, wherein a substantial amount of light emitted by the third light emitting diode does not traverse a lens.

7. The lighting device of claim 1, wherein the third light emitting diode is red colored.

8. The lighting device of claim 7, wherein the first and second light emitting diodes are white colored.

9. A lighting device comprising:

a front housing;

a first light emitting diode located on the front housing;

a second light emitting diode located on the front housing and spaced from the first light emitting diode;

a center of a first lens arranged in a central axis of a light path of the first light emitting diode for focusing a first light beam onto a target area;

a center of a second lens arranged in a central axis of a light path of the second light emitting diode for focusing a second light beam onto the target area;

a rear housing coupled to a back side of the front housing, the rear housing having a battery compartment;

a cover disposed over a front of the front housing, the cover supporting the first and second lenses relative to the first and second light emitting diodes; and a third light emitting diode located between the first and the second light emitting diodes, wherein a light path of the third light emitting diode projects through a region of the cover disposed between the first and second lenses.

10. The lighting device of claim 9, wherein the first and second lenses are magnifying lenses.

11. The lighting device of claim 9, wherein the cover supports the first and second lenses in a tilt arrangement with respect to the target area.

12. The lighting device of claim 9, wherein the first and second light beams substantially overlap at the target area.

13. The lighting device of claim 9, wherein a substantial amount of light emitted by the third light emitting diode does not traverse a lens.

14. The lighting device of claim 9, wherein the front housing is pivotally connected to the rear housing to allow the front housing and the light emitting diodes to be moved relative to the rear housing.

15. The lighting device of claim 9, wherein the third light emitting diode provides a flood light.

16. The lighting device of claim 9, wherein the third light beams has a field of view of about forty degrees.

17. The lighting device of claim 9, wherein the third light emitting diode provides a red light.

18. The lighting device of claim 9, wherein the front housing is rotatable about a horizontal axis relative to the rear housing.

19. The lighting device of claim 18, further comprising a hinge assembly on the horizontal axis that couples the front housing and the rear housing.

* * * * *